United States Patent [19]

Ogimoto et al.

[11] 4,293,240

[45] Oct. 6, 1981

[54] METHOD FOR INSTALLING AN ELECTRIC POWER PLANT

[75] Inventors: Kazuo Ogimoto, Fujisawa; Tomohiro Inoue, Yokohama; Susumu Tanaka, Ushiku; Yoshio Kobayashi, Ooi, all of Japan

[73] Assignee: Tokyo Shibaura Denki Kabushiki Kaisha, Japan

[21] Appl. No.: 79,465

[22] Filed: Sep. 27, 1979

[30] Foreign Application Priority Data

Oct. 5, 1978 [JP] Japan ..... 53-122013

[51] Int. Cl.[3] ..... E02D 21/00

[52] U.S. Cl. ..... 405/195; 405/203; 405/204

[58] Field of Search ..... 405/203, 204, 209, 195, 405/208, 205, 206, 207

[56] References Cited

U.S. PATENT DOCUMENTS

| | | | |
|---|---|---|---|
| 875,699 | 1/1908 | Dumais | 405/204 |
| 1,310,461 | 7/1919 | Williams | 405/204 |
| 2,900,794 | 8/1959 | Sutton | 405/204 |
| 3,464,212 | 9/1969 | Yamagata et al. | 405/204 |
| 3,589,133 | 6/1971 | Lond | 405/204 |
| 3,962,877 | 6/1976 | Schiemichen | 405/203 |
| 4,007,598 | 2/1977 | Tax | 405/204 X |

FOREIGN PATENT DOCUMENTS

| | | | |
|---|---|---|---|
| 1497544 | 9/1967 | France | 405/203 |
| 31541 | 3/1977 | Japan | 405/203 |

OTHER PUBLICATIONS

IHI Engineering Review, vol. 18, No. 2 (UDC 676.16.013:629.124, Mar. 1978), pp. 115–146, The IHI--developed IP System Pulp Plant.

*Primary Examiner*—Dennis L. Taylor

*Attorney, Agent, or Firm*—Stevens, Davis, Miller & Mosher

[57] ABSTRACT

A method for installing an electric power plant comprises preparing a plant yard in the form of a shallow pool connected to a water area. The electric power plant is in a package form comprising a floatable base, and is mounted on a submersible barge and towed. Near the plant yard, the package is unloaded and moved into the plant yard when the water is at a high level. Water is then introduced into a ballast tank of the base of the package to cause the package to sink onto the foundation forming the bottom of the pool.

6 Claims, 14 Drawing Figures

METHOD FOR INSTALLING AN ELECTRIC POWER PLANT

BACKGROUND OF THE INVENTION

The present invention relates to a method for installing an electric plant.

In the past, construction of an electric plant such as a steam electric power generating plant involved civil engineering works at the site for the plant, construction of a foundation of the turbine generator, building of a turbine shed, construction of a steel frame, erection of a drum of a boiler, and installation of various equipments, and installation of the principal apparatus had to be carried out in time with the progress of the civil engineering works and the building of the turbine shed. Where the plant is to be built at a site having adverse conditions, the installation works take a long time and require a large portion of the cost of building the plant. Since it is necessary to transport each equipment in time with installation of each equipment, the cost of transport also is high. Moreover, where the plant is to be built in an underdeveloped area, it is difficult to secure skilled workers for the construction of the plant.

SUMMARY OF THE INVENTION

An object of the present invention is to reduce the term and the cost of constructing and installing an electric plant.

According to the invention, there is provided a method for installing an electric power plant comprising the steps of: preparing, at a site where the plant is to be installed, a plant yard in the form of a shallow pool having a foundation forming at least part of the bottom of the pool, the plant yard being connected to a water area whose level varies with time; mounting, in a dockyard, equipments forming the plant on a floatable base to form a package; mounting the package on a submersible barge; towing the barge with the package mounted thereon to the water area; unloading the package from the barge; moving the package into the plant yard when the water is at a high level; and introducing water into the ballast tank of the base of the package to cause the package to sink onto the foundation.

BRIEF DESCRIPTION OF THE DRAWINGS

In the accompanying drawings.

DESCRIPTION OF THE PREFERRED EMBODIMENTS

Figure 1:
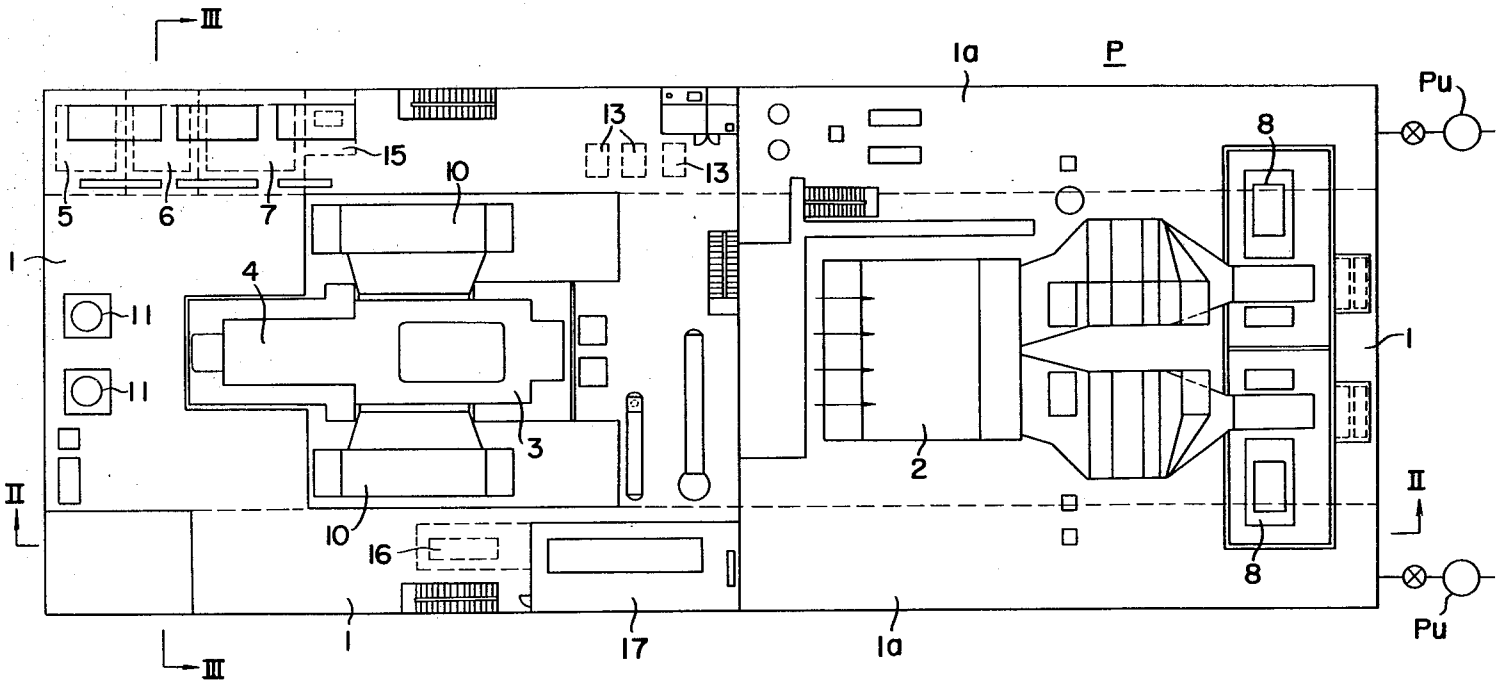
FIG. 1 is a plan view, partially cut away, of a package-type electric power plant according to the invention.
Figure 2:
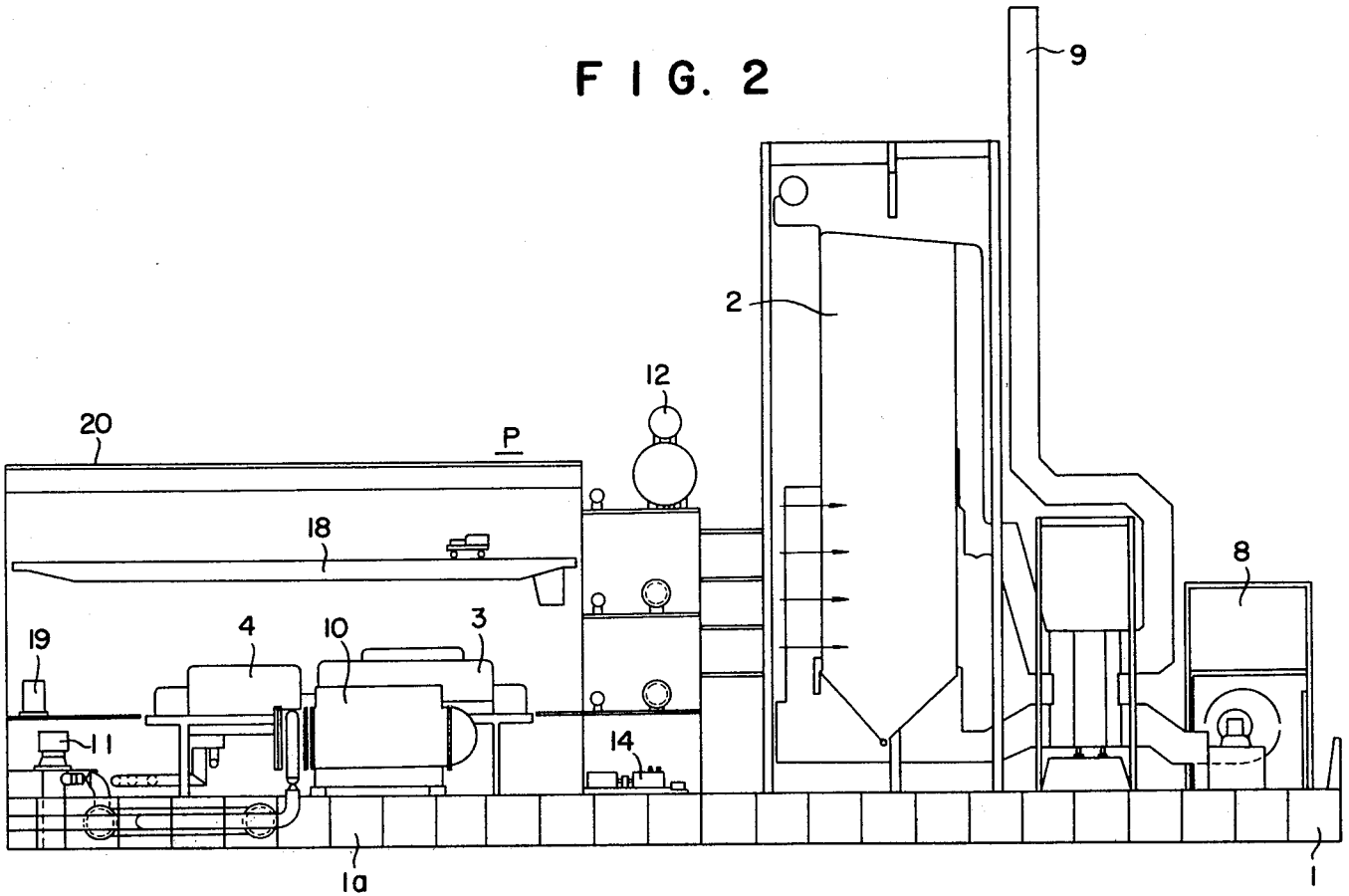
FIG. 2 is a sectional view taken along the line II—II in FIG. 1.
Figure 3:
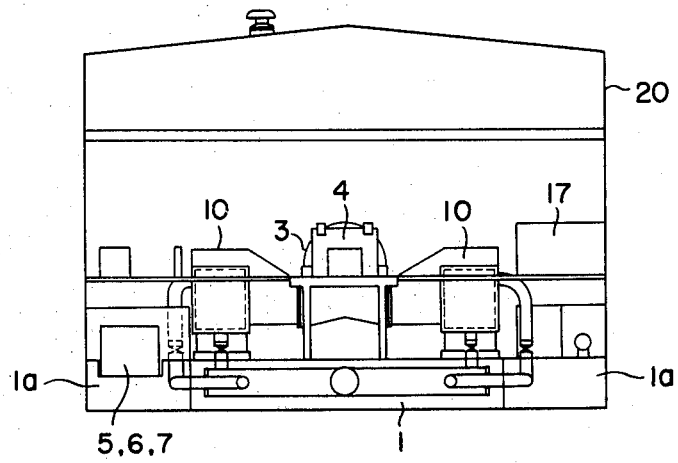
FIG. 3 is a sectional view taken along the line III—III in FIG. 1.

Referring now more particularly to FIGS. 1 through 3, there is shown a package-type electric power plant which is transported and installed according to the method of this invention. The plant is shown to be a steam electric power generating plant, which comprises a base 1 having ballast tanks 1*a*. The base 1 is constructed in a dockyard in a manner similar to that in which an ordinary ship is built. Mounted on the base 1 are principal equipments such as a boiler 2, a steam turbine 3, an electric generator 4, and transformers 5, 6, 7 as well as their attachment such as a forced draft fan 18, a smoke stack 9, a condenser 10, a water circulating pump 10, a deaerator 12, a compressor 13, a water feed pump 14, a hydrogen gas generator 15, batteries 16, a control room 17, a crane 18 and a hoist, not shown, and an emergency generator 19 which are arranged and connected in a manner well known in the art. These equipments are formed as a huge package P, and are protected by a turbine generator shed 20. These equipments forming the package P are each manufactured in a factory under a strict control in a short time and are mounted and assembled on the base 1.

The ballast tank 1*a* provided in the base 1 selectively causes the base 1 to float or sink in water. For instance the depth to which the base 1 is immersed is designed to be 3.2 m–3.5 m. To put the package P out of the dockyard, sea or river water is introduced into the dockyard and the package P is made to float and moved out.

Figure 4:
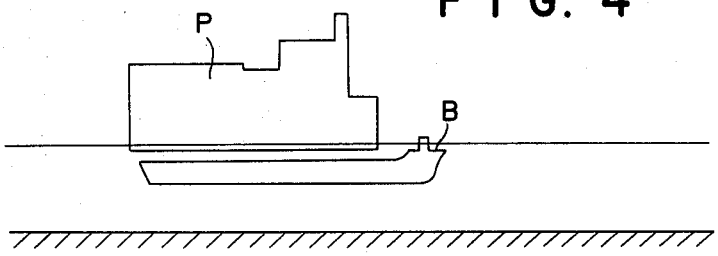
FIGS. 4 through 6 are schematic views showing how the package-type electric power plant is transported.

On a calm sea near the dockyard, the package P is loaded on a submersible barge B. As illustrated in FIG. 4, a submersible barge B is made to sink by introducing water into its ballast tank, not shown. Then, the package P is caused to come above the barge B. After that, water is discharged from the ballast tank of the barge B, so that the barge B floats to support the package P.

Figure 5:
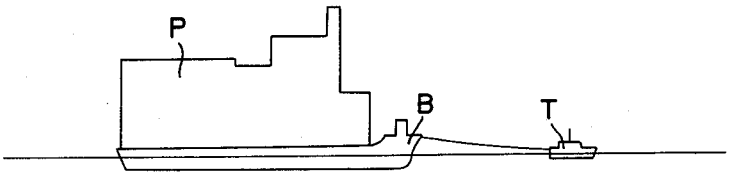

A tug boat T is used for towing the barge B with the package P mounted on it (FIG. 5).

Figure 6:
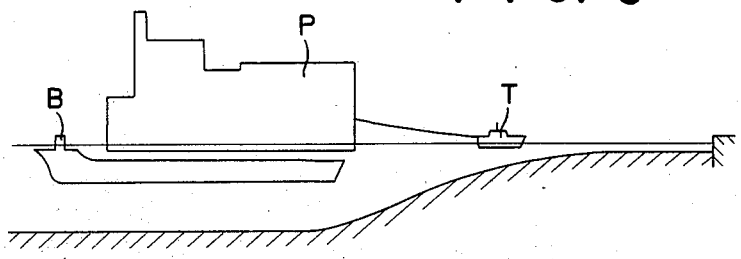

As the barge reaches a sea shore or a river shore near the site where the plant is to be installed, the package P is unloaded from the barge B, by having the submersible barge B sink to cause the package P to float (FIG. 6).

A plant yard PY is provided with a presettled foundation prepared in advance. The plant yard PY is in the form of a relatively shallow pool which is sufficiently deep (for instance 4–5 m) for the package to float at a high water level and the depth is insufficient (for instance 2–3 m) for the floatation at a lower water level.

In the illustrated embodiment, the plant yard PY has a space for permitting installation of four packages.

A beaching canal H extends from the plant yard crossing the sea or river bank SB to the sea or river. The beaching canal H is sufficiently deep (for instance 4 –5 m) for the floatation of the package P even at a low water-level.

Figure 7:
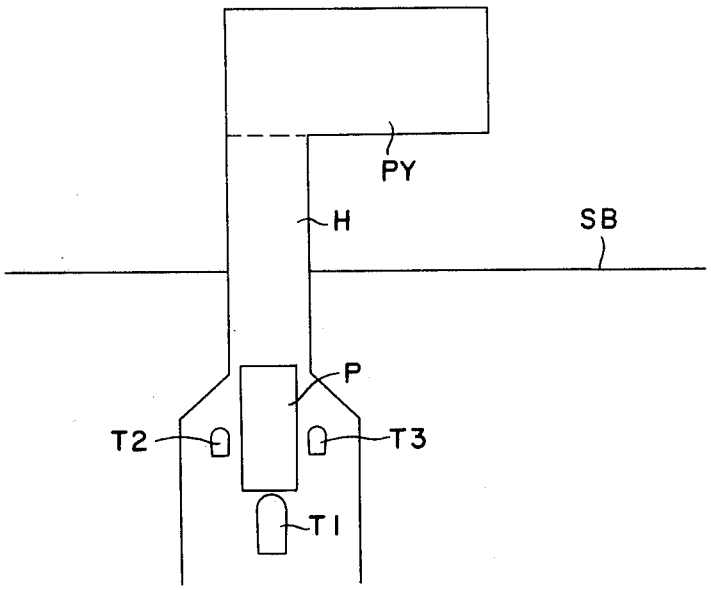
FIGS. 7 through 9 are schematic views showing how the package-type electric power plant is moved into the plant yard.
Figure 8:
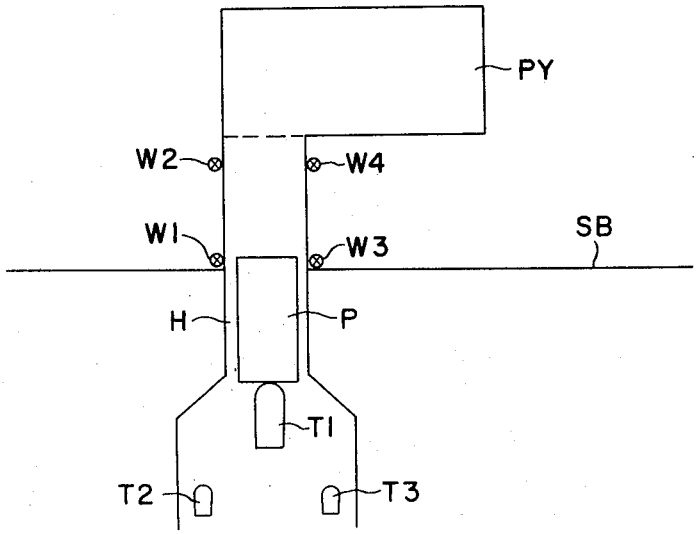

The package P, having floated from the submersible barge B, is moved by tug boats $T_1$, $T_2$ and $T_3$ (FIG. 7) to the entrance of the canal H, and is pulled by winches $W_1$, $W_2$, $W_3$ and $W_4$ mounted on the shore (FIG. 8).

Figure 9:
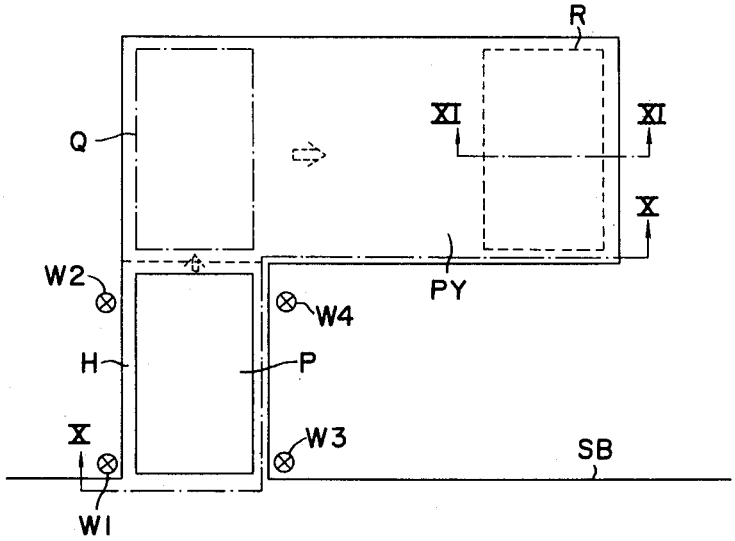

The package P is moved to the extremity of the relatively deep canal (FIG. 9).

Figure 10A:
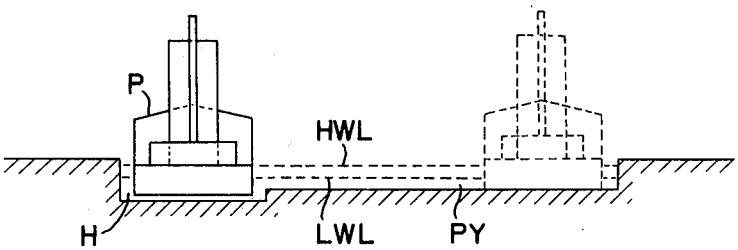
FIGS. 10A through 10C are sectional views taken along the line X-X in FIG. 9 showing how the package-type electric plant is installed on the bed of the plant yard.
Figure 10B:
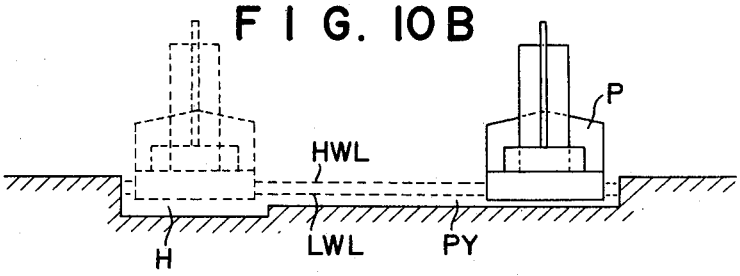
Figure 10C:
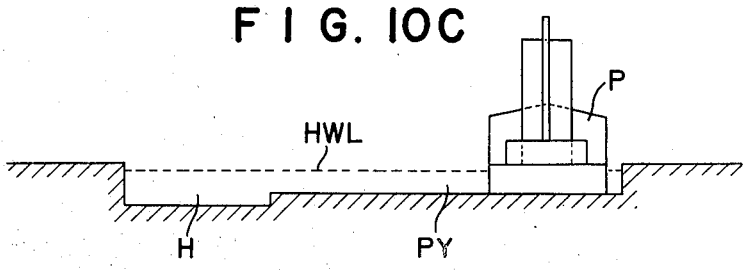

FIGS. 10A through 10C show cross sections along the line X—X, at different stages. HWL and LWL respectively indicate the high and low water levels.

In FIG. 10A, the package P is at the extremity of the canal H. If it is then at a low water level, movement of the package P is postponed until rise of the water level. When the water level increases, the package P is moved, by means of winches not shown, to the position Q (indicated by a chain line) in the plant yard PY and further to the position R (indicated by a dotted line) preselected for the particular, in this case the first, plant (FIG. 10B).

As the package P reaches the preselected position, water is introduced by means of a pump $P_u$ into the ballast tank of the base 1 so that the base 1 sinks onto the preformed foundation PY (FIG. 10C). The height of the base 1 is sufficient (for instance 5 -6 m) to prevent ingress of water when the package sinks onto the foundation.

The second to fourth packages are placed at the respective preselected positions.

Then exterior of the bases is filled with soil S, or concrete (FIG. 11), and thus the pool is reclaimed.

After that, the water in the ballast tank in the base is discharged.

Figures 11, 12:
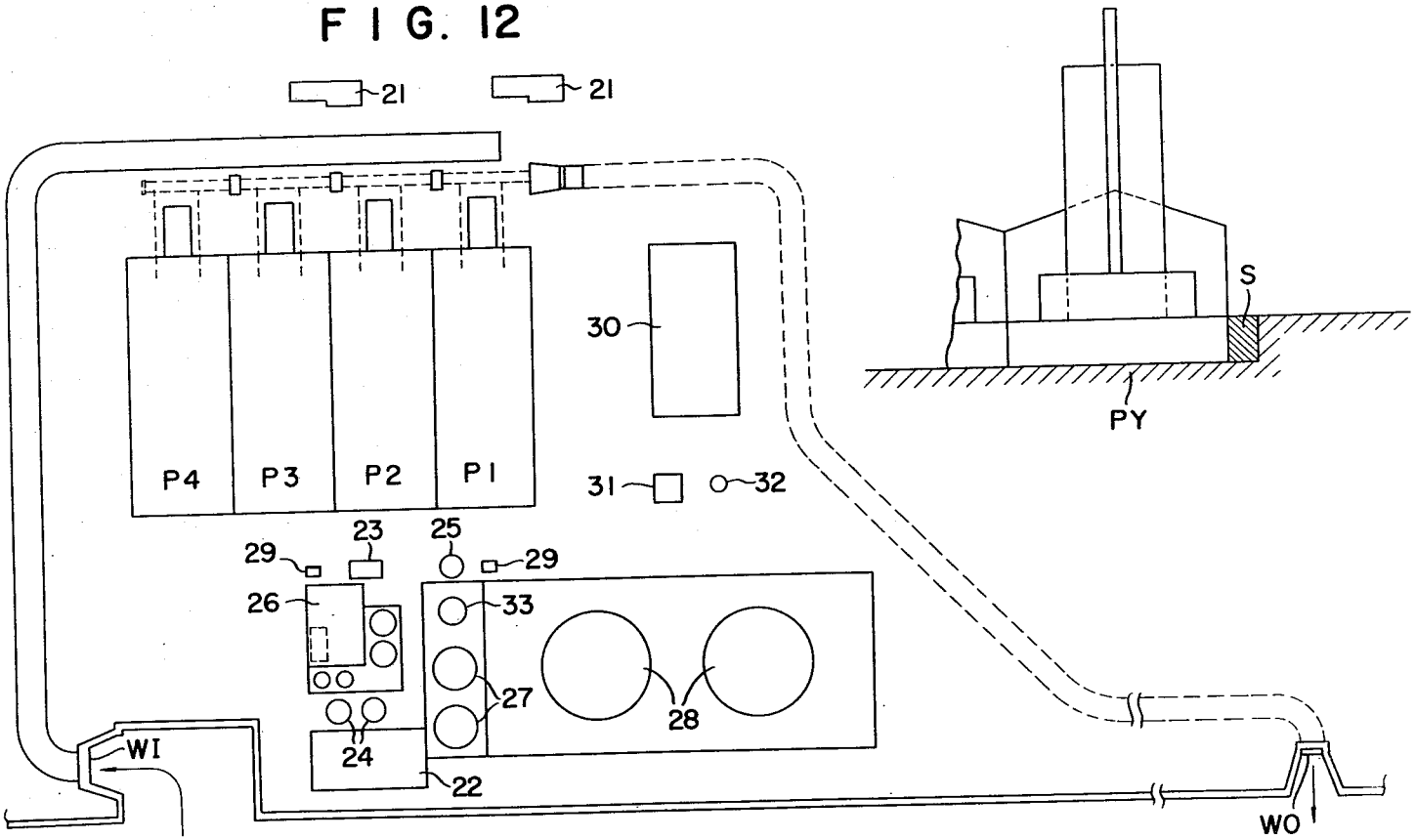
FIG. 11 is an enlarged sectional view taken along the line XI—XI in FIG. 9 showing the state after the plant yard is reclaimed.
FIG. 12 is a plan view of the completed electric power plant with attached facilities.

The completed plant is shown in FIG. 12, from which it will be seen that the four packages $P_1$ through $P_4$ are placed adjacent to each other. In the vicinity of the packages, there are provided substations 21, a desalination plant 22, an auxiliary boiler 23, a fresh water tank 24, a make-up water tank 25, a demineralizing equipment 26, a fuel tank 27, a fuel storage tank 28, a lubricating oil storage tank 29, a service building 30, a fire extinguishing pump house 31, a fire extinguishing water tank 32 and a light oil tank 33. Also shown are cooling water intake WI and cooling water outlet WO. The equipments provided in the vicinity of the packages are installed at the site in time with the construction and transportation of the packages P, and are connected to the packages P upon implantation thereof. Then, the plant is ready for operation.

In the illustrated embodiment, the electric plant is shown as comprising a steam electric power generating plant. However, a fuel tank, a desalination equipment, a substation, a service building and the like may also be formed into a package and installed in a manner described above.

Also, the package may alternatively comprise an $SF_6$ gas insulated switch gear having a circuit breaker, a disconnecting switch, an instrument transformer, and a lightning arrester.

The invention is not limited to a method where the package P is moved into the plant yard at high tide, but is applicable where the water level varies for some other reason. In any case, shifting of the package into the plant yard is carried out when the water level is high, so that the pool of the plant yard PY can be made shallow, and hence the cost of construction of the plant yard is low.

The beaching canal H has been described to extend to the sea. However, it may alternatively be provided to extend to a river. In this case, the package P is desirably towed to the part of the river near the site for the plant.

According to the invention, the period for construction of an electric power plant at the site is substantially reduced. Also, since the various equipments are assembled to form a package and transported the cost of transportation is reduced. Moreover, the equipments forming the package are assembled in the dockyard, the quality of the resultant plant is ensured. Since the package is floatable by the use of a base, rather than a ship which has to be designed to sail over rough seas, the cost of construction is much less.

What is claimed is:

1. A method for installing an electric power plant comprising the steps of:

preparing, at a site where the plant is to be installed, a plant yard in the form of a shallow pool having a foundation forming at least part of the bottom of said pool, said plant yard being connected to a water area whose level varies with time due to ebb and flow, the bottom of said pool being at a lower level of said water area at least when said water level is at a high water level, mounting, in a dockyard, equipment forming the plant on a floatable base to form a floatable package, submerging a submersible barge having ballast tanks, moving said package over said submersible barge for support thereon, said barge including ballast tanks, towing said barge with said package supported thereon to said water area, unloading said package from said barge by submerging said barge whereby said package floats, moving said package into said plant yard when the water is at a high level, and introducing water into said ballast tank of said base of said package to cause said package to sink onto said foundation.

2. A method according to claim 1, further comprising the step of reclaiming said pool with soil or concrete after said package is made to sink onto the foundation.

3. A method according to claim 1, wherein said equipments forming said plant comprise a boiler, a steam turbine, and an electric generator.

4. A method according to claim 1, wherein said equipments forming said plant comprise a circuit breaker, a disconnecting switch, an instrument transformer, and a lightning arrester.

5. A method according to claim 1, wherein said plant yard is connected to said water area by a canal, and said package is moved into said plant yard through said canal.

6. A method according to claim 1, wherein said pool forming said plant yard is sufficiently deep for said package to be moved thereinto only when the water is at the high level.

* * * * *